US006878035B2

(12) United States Patent
Varney et al.

(10) Patent No.: US 6,878,035 B2
(45) Date of Patent: Apr. 12, 2005

(54) TOOL SHARPENER

(75) Inventors: Gary Varney, Medford, OR (US); Dennis Sobolik, Ashland, OR (US); Will Hilligoss, Ashland, OR (US); Jim Wiltrout, Medford, OR (US); John Griffin, Ashland, OR (US); Jennifer Hanson, Ashland, OR (US)

(73) Assignee: Darex Corporation, Ashland, OR (US)

( * ) Notice: Subject to any disclaimer, the term of this patent is extended or adjusted under 35 U.S.C. 154(b) by 0 days.

(21) Appl. No.: 10/393,343

(22) Filed: Mar. 21, 2003

(65) Prior Publication Data

US 2004/0106356 A1 Jun. 3, 2004

Related U.S. Application Data

(60) Provisional application No. 60/366,254, filed on Mar. 22, 2002.

(51) Int. Cl.[7] ..... B24B 49/00

(52) U.S. Cl. ..... 451/5; 450/8; 450/11; 450/140

(58) Field of Search ..... 451/5, 6, 7, 8, 451/9, 10, 48, 124, 140, 141, 456, 461

(56) References Cited

U.S. PATENT DOCUMENTS 4,195,449 A * 4/1980 Scarpa et al. ..... 451/355
4,227,902 A * 10/1980 Olson ..... 55/302
4,329,096 A * 5/1982 Herscovici ..... 409/15
4,762,040 A * 8/1988 Alcantara Perez et al. ..... 83/56
4,782,633 A * 11/1988 Fuller, Jr. ..... 451/9
4,819,515 A * 4/1989 Pfaltzgraff ..... 76/41
5,609,512 A * 3/1997 Holmes et al. ..... 451/48
5,863,238 A * 1/1999 Felstehausen ..... 451/65
6,190,242 B1 * 2/2001 Herrscher et al. ..... 451/177
6,283,824 B1 * 9/2001 Mortell et al. ..... 451/5
6,331,133 B1 * 12/2001 Katayama et al. ..... 451/9
6,419,562 B1 * 7/2002 D'Ambra ..... 451/48
6,652,367 B1 * 11/2003 Lin ..... 451/178

* cited by examiner

*Primary Examiner*—M. Rachuba
(74) *Attorney, Agent, or Firm*—Miles & Stockbridge P.C.; Edward J. Kondracki

(57) ABSTRACT

A tool sharpener especially designed for sharpening drill bits is provided. The tool sharpener includes a grinding wheel subassembly, a tool holder subassembly, such as a drill chuck, an infeed stage subassembly, a cross feed stage subassembly, and a processor which is capable of controlling each of the subassemblies, and moving the subassemblies relative to the grinding wheel, in preprogrammed routines, to effect the sharpening of a tool such as a drill bit.

19 Claims, 14 Drawing Sheets

TOOL SHARPENER

CROSS REFERENCE TO RELATED APPLICATION

This application contains subject matter disclosed in Provisional Patent Application No. 60/366,254, filed Mar. 22, 2002, the disclosure of which is hereby expressly incorporated by reference. This application claims the benefit of the filing date of that application.

BACKGROUND OF THE INVENTION

1. Field of the Invention

The present invention is directed to a tool sharpener, and, more particularly to an automated tool sharpener especially for use in sharpening drills.

2. Description of Related Art

Tool sharpeners for sharpening the tips of drills and the cutting faces of other cutting tools have heretofore been developed in the art. Such tool sharpeners extend the operating life of drills and other cutting tools, in that a tool having dull cutting surfaces will not perform with the desired precision or speed, and, if not sharpened, must be discarded even though the tool has a considerable amount of usable material left to work with.

Particularly in industrial applications, the drills or other cutting tools are expensive items, and where change out and resharpening is not part of the normal equipment operating procedure, there is a tendency to try to prolong the useful life of the drill by using it after it has dulled and is not performing optimally. This adversely affects the quality of the products being produced. Accordingly, commercial grade or industrial grade tool sharpeners have been developed in order to prolong the useful life of drills and other cutting tools, and in order to permit the equipment to be operated substantially continuously with a drill or cutting tool of proper sharpness.

A recent example of a commercial-grade tool sharpener is disclosed in U.S. Pat. No. 5,400,546, which is assigned to the assignee of the present application. The disclosure of that patent is hereby expressly incorporated by reference herein. That tool sharpener has enjoyed considerable commercial success, and is capable of providing highly precise sharpening of a drill. The sharpener does, however, require that several operations be carried out manually, or involve manual manipulations, including aligning the drill properly in the chuck (aided by an alignment device on the sharpener), tightening the drill in the chuck, and then manually manipulating the chuck and drill in one or more sharpening or dressing ports.

Use of this sharpener is somewhat labor intensive, and despite the fact that the design of the sharpener greatly reduces the potential for operator error, and limits the degree of possible error which can result in an improperly sharpened drill, that possibility continues to exist.

Modern cutting tools are high performance, complex and expensive devices that can not readily be sharpened manually without a great deal of effort and skill.

Accordingly, a need has been identified by the present inventors to provide a tool sharpener that automates most, if not all, of the operations necessary to properly sharpen a drill or other cutting tool. The automation of the majority of the operations results in the sharpening operation being less labor-intensive and less prone to sharpening errors committed by the person operating the sharpener. This will also permit a less-skilled laborer to be entrusted with the tool sharpening function, resulting in potentially reduced labor costs.

It is therefore a principal object of the present invention to provide a tool sharpener which accepts a tool to be sharpened, and which performs most or all operations related to the sharpening in an automated mode.

SUMMARY OF THE INVENTION

The tool sharpener of the present invention is, in essence, a 4-axis CNC (computer numeric control) machine especially designed for tool sharpening. In meeting the need for a more highly automated, less labor-intensive tool sharpener, the design of the tool sharpener of the present invention centers around microprocessor control of most aspects of the sharpening process. A user will insert a tool, normally a drill, into a chuck, and enter the type of point on that drill into a user interface, such as a console or touch screen having illustrations of the various drill point types. The user will then enter a start command, for example, by pressing a "cycle start" button on the console.

The processor in the device is programmed with routines to effect all of the desired tool sharpening steps from that point on. The processor will, aided by sensors, send appropriate control signals to step motors in an infeed stage subassembly, a cross feed stage subassembly, a swing assembly, a chuck rotation subassembly and to a grind motor, to effectuate a sharpening of the drill to the type of point selected by the user.

The use of 4-axis control allows this tool sharpener to sharpen all industry standard drill points, namely conic and facet (sometimes referred to as four-facet) points, and the standard (X) and radial (R) split points of both conic and facet points. The range of movement of the chuck relative to the grinding wheel is designed to permit the sharpener to create point angles from 90° to 150°. The chuck and sharpening chamber are designed such that drills or other elongate tools of approximately ⅛" to ⅝" in diameter, and from about two (2) to about nine (9) inches in length can be sharpened by this single piece of equipment.

The sensors employed in the device, which aid the processor in setting up and controlling the sharpening process, automatically sense the length of the portion of the drill protruding from the chuck (stickout length) and the diameter of the drill and find the cutting edge of the drill. The processor is also programmed to employ information from the cutting edge sensor to calculate the web thickness of the drill, which enables the proper alignment of the drill for the sharpening operation.

The tool sharpener provides many other significant features or functions not previously employed on existing tool and drill sharpeners.

The chuck assembly is provided with an automated locking mechanism that prevents the chuck from rotating while the drill is being installed (inserted) and removed. This obviates the need for a manual locking mechanism, which would make the drill loading and unloading cumbersome.

Also in the preparatory stages of the drill sharpening cycle, the sharpening device is able to detect the diameter of the drill to be sharpened by sensing the length of a rod protruding from the chuck assembly. The rod moves along an axis parallel to the drill positioned in the chuck, in response to the tightening of the chuck jaws. As the chuck jaws advance further inwardly to engage the drill, the rod extends farther and farther away from the chuck assembly. Once the length of the protruding rod is determined, the processor of the device calculates the corresponding drill diameter based upon an embedded algorithm.

The web thickness is also determined automatically. A fiber optic sensor detects multiple points along the cutting edge, and, based upon incremental rotations from point to point, the processor is able to calculate the web thickness. This fiber optic sensor is also used to orient the drill to the proper grind position, based upon the detection of the cutting edge characteristics. The length of the drill protruding from the chuck is also sensed so that the processor can compensate for variances in length through control of the step motors.

Several advanced features are provided in the grinding subassembly. A grind motor current sensor is provided so that the current drawn by the grind motor can be monitored, in order to enable the control processor to control the force of the tool against the grind wheel. This control feature can be used to prevent overheating and burning of the drill material, which adversely affects the usable life of the drill, and can protect against damage to the grind wheel due to excessive pressure being applied. The grind motor itself is provided with a cooling shroud which draws air across the motor case, in order to reduce the temperature of the operating motor. This enhances motor performance and maximizes motor brush life.

In addition, the grinding subassembly provides a hone or brush, mounted adjacent to the grinding wheel in a position whereby a drill which is to be honed (polished) as part of the sharpening process, which is a highly desirable step especially for carbide cutting tools, may be moved away from the grind wheel and into contact with the hone. The hone is mounted to, but separable from the grinding wheel, and thus is driven by the grind motor, as well.

Other features and functions provided by the device of the present invention which are not present in existing tool sharpeners will be discussed elsewhere herein in greater detail.

BRIEF DESCRIPTION OF THE DRAWINGS

The above and other features of the present invention and the attendant advantages will be readily apparent to those having ordinary skill in the art, and the invention will be more easily understood from the following detailed description of the preferred embodiments of the present invention, taken in conjunction with the accompanying drawings, wherein.

DETAILED DESCRIPTION OF THE PREFERRED EMBODIMENT

Figure 1:
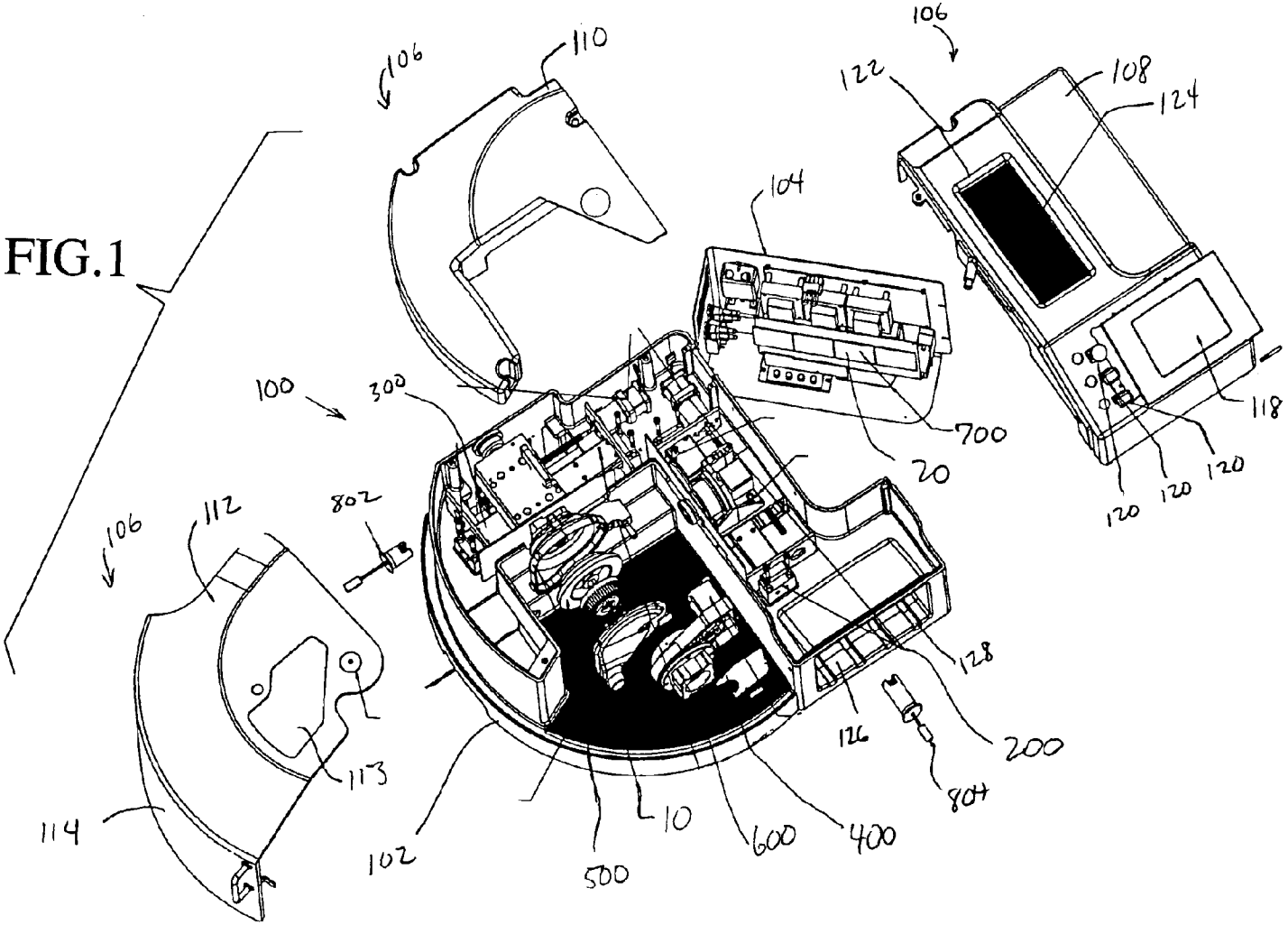
FIG. 1 is an exploded perspective view of the tool sharpener according to a preferred embodiment.

FIG. 1 illustrates the tool sharpener according to a preferred embodiment in an exploded or breakaway view. The casing or housing 100 comprises a main base 102 and an electronics housing 104 which connects to the main base to complete the overall base.

A three-piece cover 106 is provided in this embodiment. A side cover element 108 and rear cover element 110 are secured in fixed position overlying main base 102 and electronics housing 104. The third cover element is a guard door 112 which is pivotably mounted to rear cover element 110. Guard door 112 has a semi-circular peripheral wall 114, as does rear cover element 110. The guard door 112 is sized such that it can pivot between an open position in which it substantially overlies the rear cover element 110, leaving grinding chamber 10 exposed to the external environment, and a closed position in which the grinding chamber 10 is substantially closed off or sealed off from the external environment.

The guard door 112 is preferably provided with a window 113 on an upper surface thereof, which permits an operator to view the sharpening operation with the guard door closed.

The cover 106 is preferably provided with an operator interface. As shown, side cover element 108 is provided with a touch screen 118 and one or more operator input buttons 120 at the front portion of the cover. Details regarding the function and operation of the operator interface will be discussed later in this specification. The side cover element 108 may preferably also be provided with an elongated (rectangular) recess 122 having a rubber or polymeric mat 124 disposed on a floor thereof, which may be used to hold tools or drills awaiting sharpening and/or tools or drills that have been sharpened. The recess is also preferably sized such that the recess can be used to determine whether a particular drill is too long to be sharpened in the unit. This may be accomplished by forming the recess such that it can receive therein drills or tools up to the maximum length that can be accommodated in the grind chamber.

A further external feature of the device is the provision, in main base 102, of a grinding wheel storage recess 126. This recess is preferably sized to retain a plurality of spare grinding wheels, and/or grinding wheels having different grinding characteristics, in a series of slots 128 provided in the recess. The slots 128 are adapted to retain the additional grinding wheels in an upright, spaced-apart relation.

Figure 2:
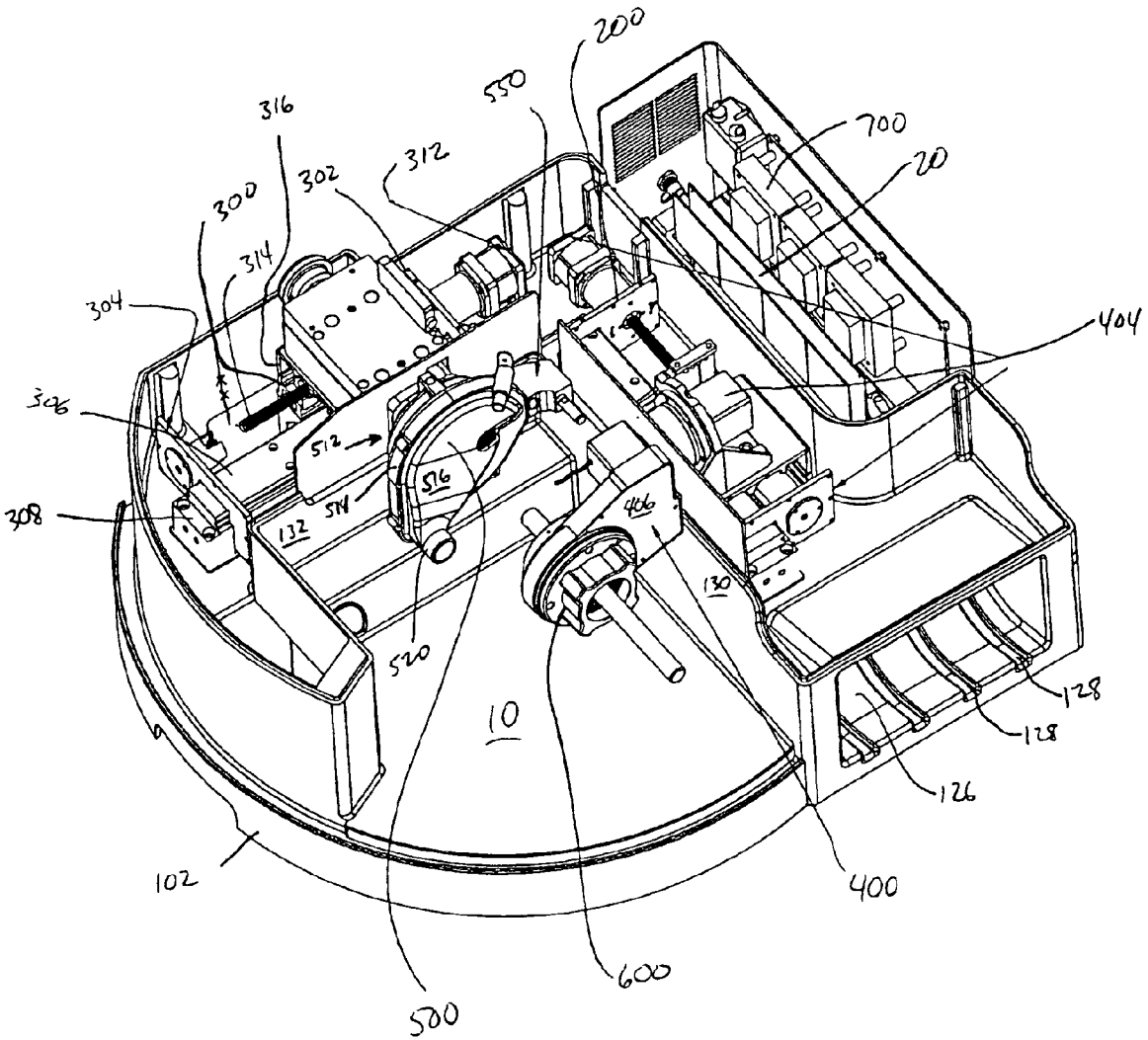
FIG. 2 is a perspective view of the tool sharpener according to a preferred embodiment, with the cover elements removed.

Turning to the internal operating components of the tool sharpener, FIGS. 1 and 2 illustrate that the sharpener preferably employs an infeed stage subassembly 200, a cross-feed stage subassembly 300, a swing subassembly 400, a grinding wheel subassembly 500, a chuck subassembly 600, and an electronics subassembly 700.

The infeed stage subassembly 200 is operably connected to the chuck subassembly 600, and is adapted to move the chuck in an "axial" direction (along an axis parallel to the axis on which the grinding wheel rotates) toward or away from the grinding wheel subassembly 500. The cross-feed stage subassembly 300 is operably connected to the grinding wheel subassembly 500, and is adapted to move the grinding wheel subassembly in a "transverse" direction (normal to the axis on which the grinding wheel rotates), in order to position the grinding wheel 502 and/or honing brush 510 relative to the tool being sharpened.

Both the infeed stage subassembly and the cross-feed stage subassembly operate using step motors and lead screws to drive guide covers along guide rails. Looking first at the infeed stage subassembly 200 (see FIGS. 1, 2 and 3) a motor-end plate 202 and a switch-end plate 204 are mounted in main base 102, with a guide rail 206 extending therebetween. The guide rail may preferably be mounted to rail supports 208, 210 disposed at the two end plates. A step motor 212 is mounted at one end of the subassembly, and is operatively coupled to a lead screw 214 extending within the subassembly 200 from motor end-plate to a distance sufficient to give guide cover 216 the necessary range of motion along the axial direction.

An infeed stage sensor 218 (FIG. 3) is mounted by sensor mount 220 to the switch-end plate 204. The function of this sensor will be discussed later in the specification.

Figure 3:
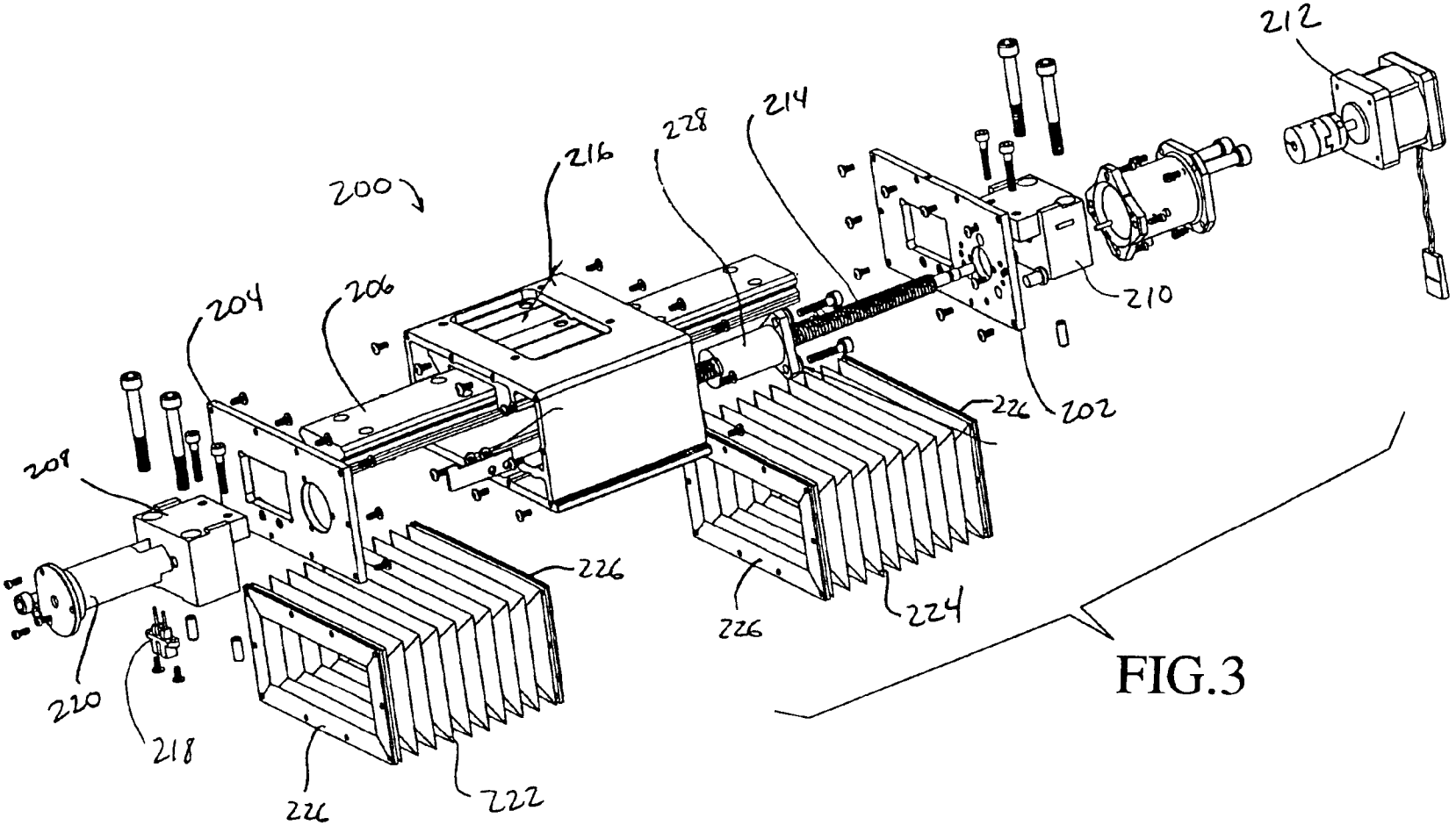
FIG. 3 is an exploded perspective view of the infeed stage subassembly in accordance with a preferred embodiment of the invention.

Referring now especially to FIG. 3, it can be seen that the moving components of the infeed stage subassembly 200 are preferably to be fully enclosed. It was determined, in designing the infeed stage subassembly 200, and cross-feed stage subassembly 300, which are more generically referred to as "linear stages", that known schemes for protecting bearing components, including the guide rail, would not provide adequate protection in this environment. The infeed stage subassembly is thus provided with two bellows elements 222, 224, which are secured between the motor-end plate 202 and a facing end of guide cover 216, and between the switch end plate 204 and the end of the guide cover 216 facing that plate. The assembly of the two end plates 202, 204, the two bellows elements 222, 224 and the guide cover 216 completely surrounds and isolates the guide rail 206 and virtually eliminates the intrusion of grinding debris into this area. The bellows elements 222, 224, may be constructed in a known manner, with rigid or semi-rigid mounting plates 226 at the two ends, and a flexible or pliant material forming the bellows.

The cross-feed stage subassembly 300 is constructed in much the same way as is infeed stage subassembly 200. A main difference is that the infeed stage subassembly is mounted to main base 102 such that the lead screw moves guide cover 216 in an axial direction, whereas the cross-feed stage subassembly 300 is oriented at a right angle to the infeed stage, so that the guide cover 316 is moved in the transverse direction. The other main difference is that these two subassemblies are operatively coupled to different subassemblies or components disposed within grinding chamber 10.

The cross-feed stage subassembly has a motor end plate 302, a switch-end plate 304, a guide rail 306, rail supports (one shown at 308), a step motor 312, a lead screw 314 operatively coupled thereto, and a guide cover 316. The cross-feed stage subassembly 300 will also preferably have a fully enclosed guide rail, employing bellows as does the infeed stage subassembly. These are not shown in FIGS. 1 and 2, however, in order that the internal components may be seen.

Turning back to the infeed stage subassembly, it can be seen that infeed guide cover 216 is operatively coupled to lead nut 228 (FIG. 3), and thus guide cover 216 moves along lead screw 214 as step motor 212 turns the lead screw 214. As can best be seen in FIG. 2, guide cover 216 has a swing step motor 404 mounted to an upper surface thereof. Swing step motor 404 is operatively coupled, through an opening between wall 130 of main base 102 and side cover 108, to a housing 406 of swing subassembly 400. The swing step motor 404 and swing subassembly 400 (which houses chuck subassembly 600 as well) are thus moved in the axial direction by infeed stage subassembly 200.

Swing step motor 404 operates to swing or tilt the swing subassembly 400, to tilt the tool to be sharpened in a substantially vertical plane normal to an axis of rotation of the shaft of step motor 404. This allows the tool or drill being sharpened to be presented at a range of angular orientations relative to the grinding wheel 502. Swing step motor 404 is operatively connected to and is controlled by central processor 20, as are all of the step motors employed in the sharpening device.

Figure 4:
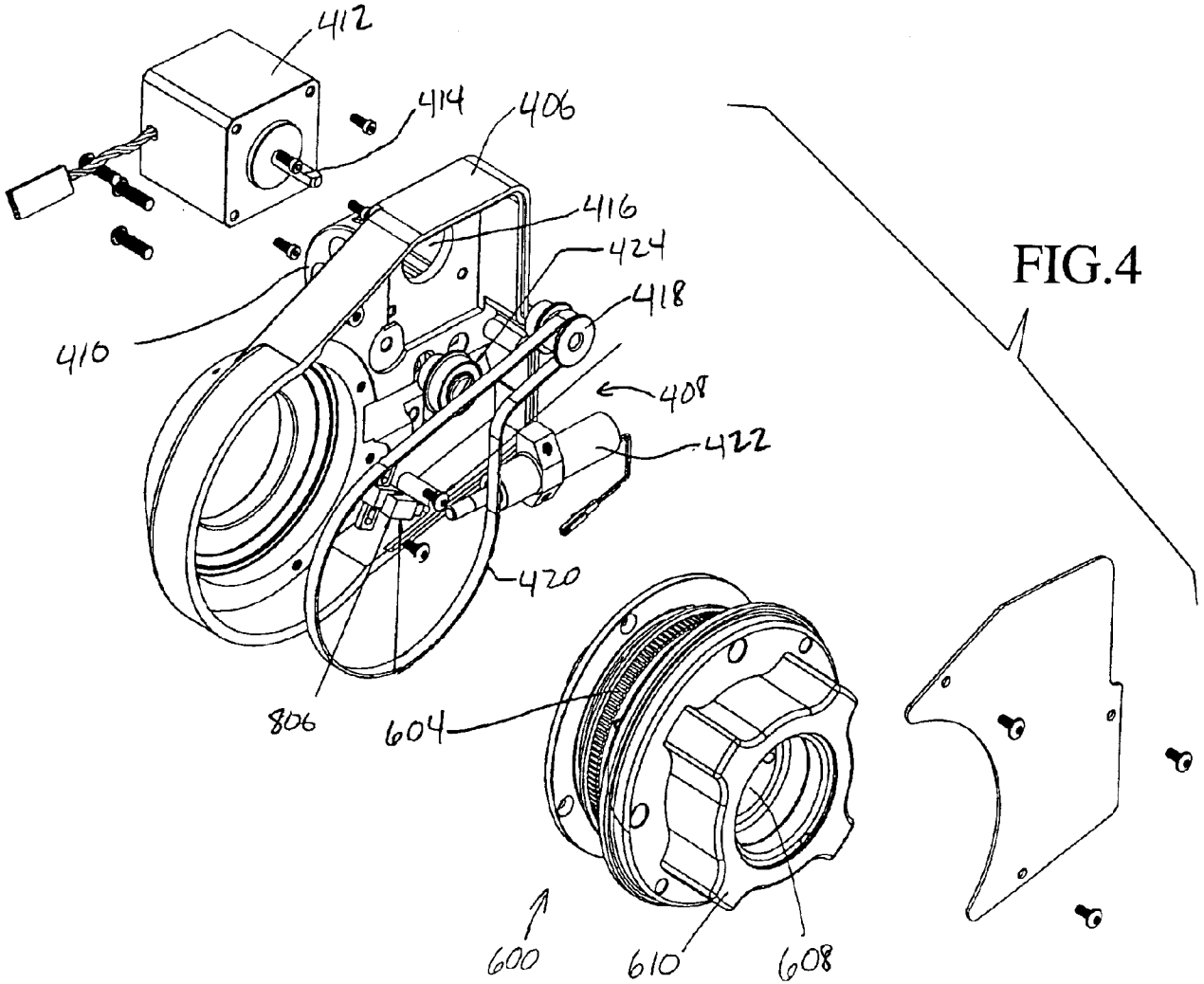
FIG. 4 is an exploded perspective view of the swing subassembly according to a preferred embodiment of the invention.

FIGS. 2 and 4 are used to illustrate the swing subassembly 400 in greater detail. The housing 406 of swing subassembly houses chuck subassembly 600 and a belt drive system 408 for rotating the chuck, and the drill or other tool held therein, about the longitudinal axis of the drill or other tool.

Swing subassembly housing 406 has a mounting flange 410 extending forwardly therefrom, which is used to mount housing 406 to step motor 404. Positioned above mounting flange 410 is a tool rotation step motor 412 having a shaft 414 protruding through opening 416 in housing 406. The step motor shaft 414 is operatively connected to drive gear 418, and a drive belt 420 loops around drive gear 418 and a chuck drive gear 604 disposed on chuck subassembly 600, and passes over idler roll 424. In this manner, tool rotation step motor 412, under the control of central processor 20, can rotate the chuck 600, and thus the tool retained therein, about the longitudinal axis of the tool, in order to present different parts of the tool point surface to the grinding wheel during sharpening. The tool rotation step motor is also used at the beginning of the sharpening cycle to properly orient the drill to the proper grind position.

The swing subassembly 400 also contains a solenoid 422 which is operable to lock the chuck to prevent the chuck from rotating during the time that the operator is installing and removing the drill. The solenoid 422 is automatically actuated to lock the chuck when the guard door 112 is open, and when no sharpening cycles are active. This makes the loading and unloading of the drill or other tool by the operator a very simple exercise, in which the drill is inserted into the central opening 608 of chuck 600, and chuck knob 610 is turned to tighten the chuck jaws 612 against the drill (see also FIG. 6).

Figure 5:
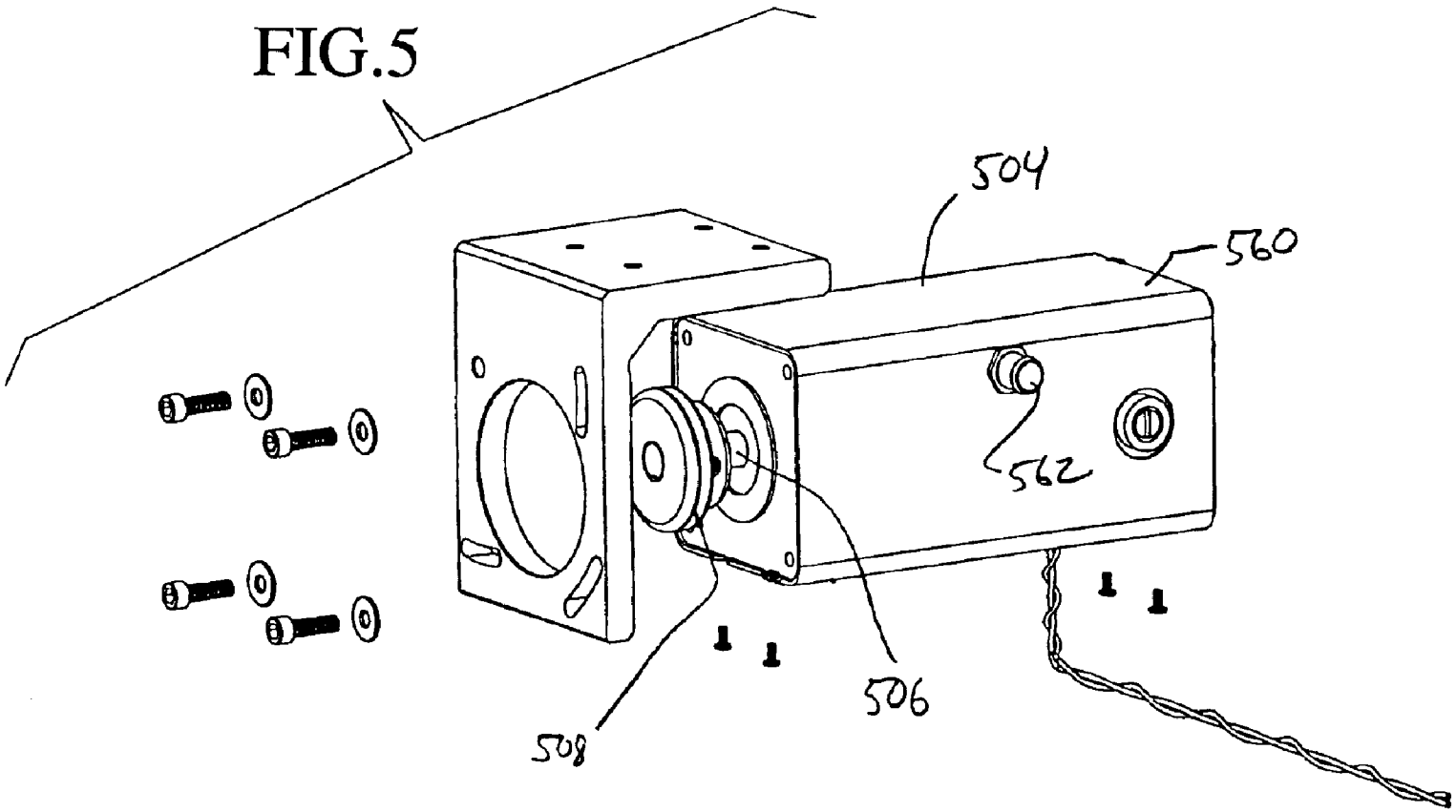
FIG. 5 is an exploded perspective view of the grind motor assembly according to a preferred embodiment of the present invention.

The grinding wheel subassembly 500 is operatively coupled to and carried by the cross-feed stage subassembly 300. In particular, a grind motor 504 is mounted to the guide cover 316, and a drive shaft 506 and drive pulley 508 (FIG. 5) extend through a wall 132 in main base 102, and into the grind chamber 10. The drive pulley is operatively coupled to grinding wheel 502 and honing brush 510, such that the drive pulley will rotate these elements. Honing brush 510 may be secured to grinding wheel 502 in a preferred embodiment, and thus would be operatively coupled to the drive pulley via the grinding wheel.

Grinding wheel 502 and honing brush 510 are preferably enclosed within a grind housing 512 comprising a rear housing member 514 and a front cover 516 which, when joined to rear housing member 514, encloses all but a small portion of the grinding wheel and honing brush. The front cover 516 is designed to be easily removable from rear housing member 514, in order that the grinding wheel and/or the honing brush may be replaced as necessary or as desired.

Figure 11:
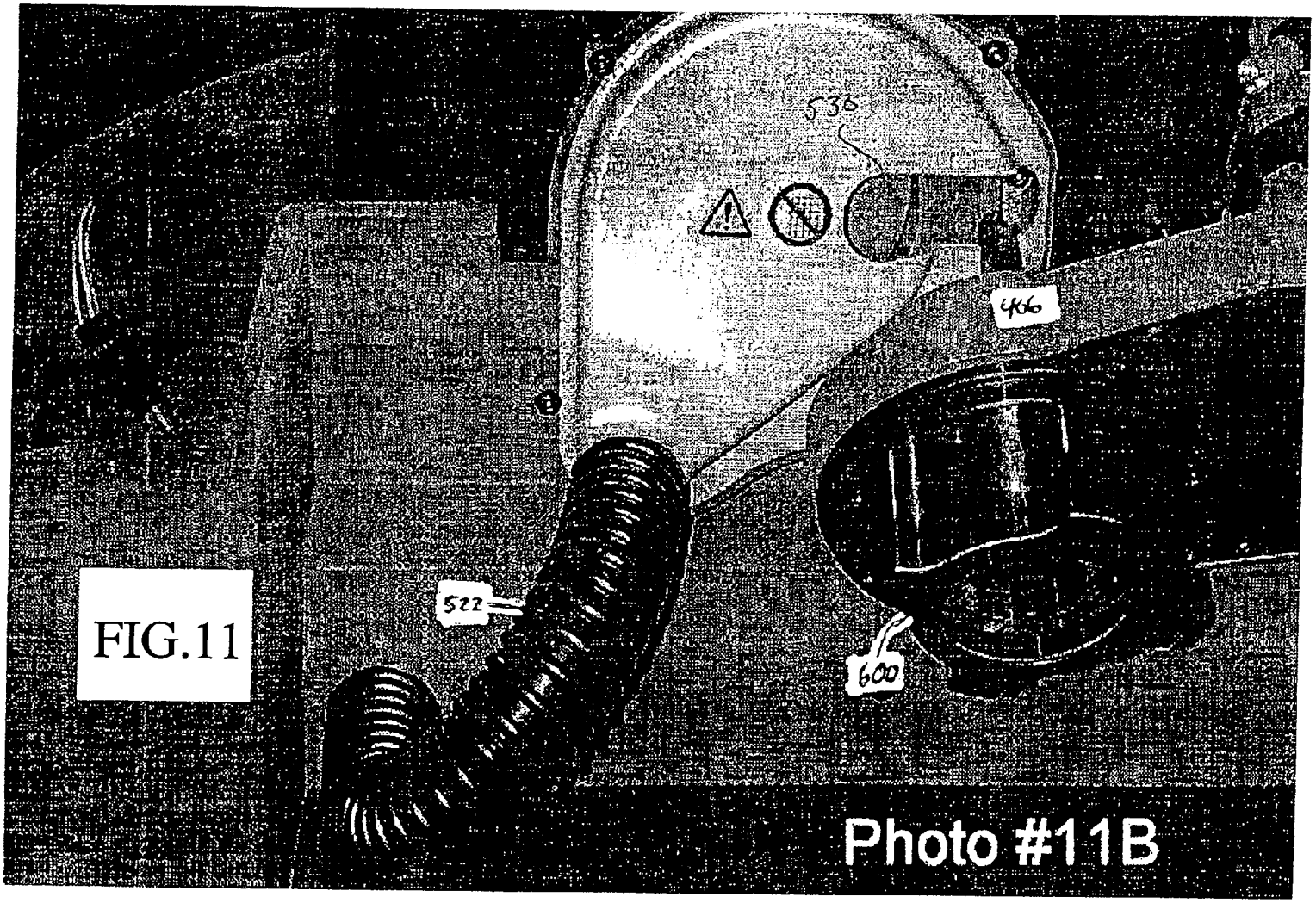
FIG. 11 is a front elevation view of the grinding wheel assembly with a drill positioned for sharpening.
Figure 12:
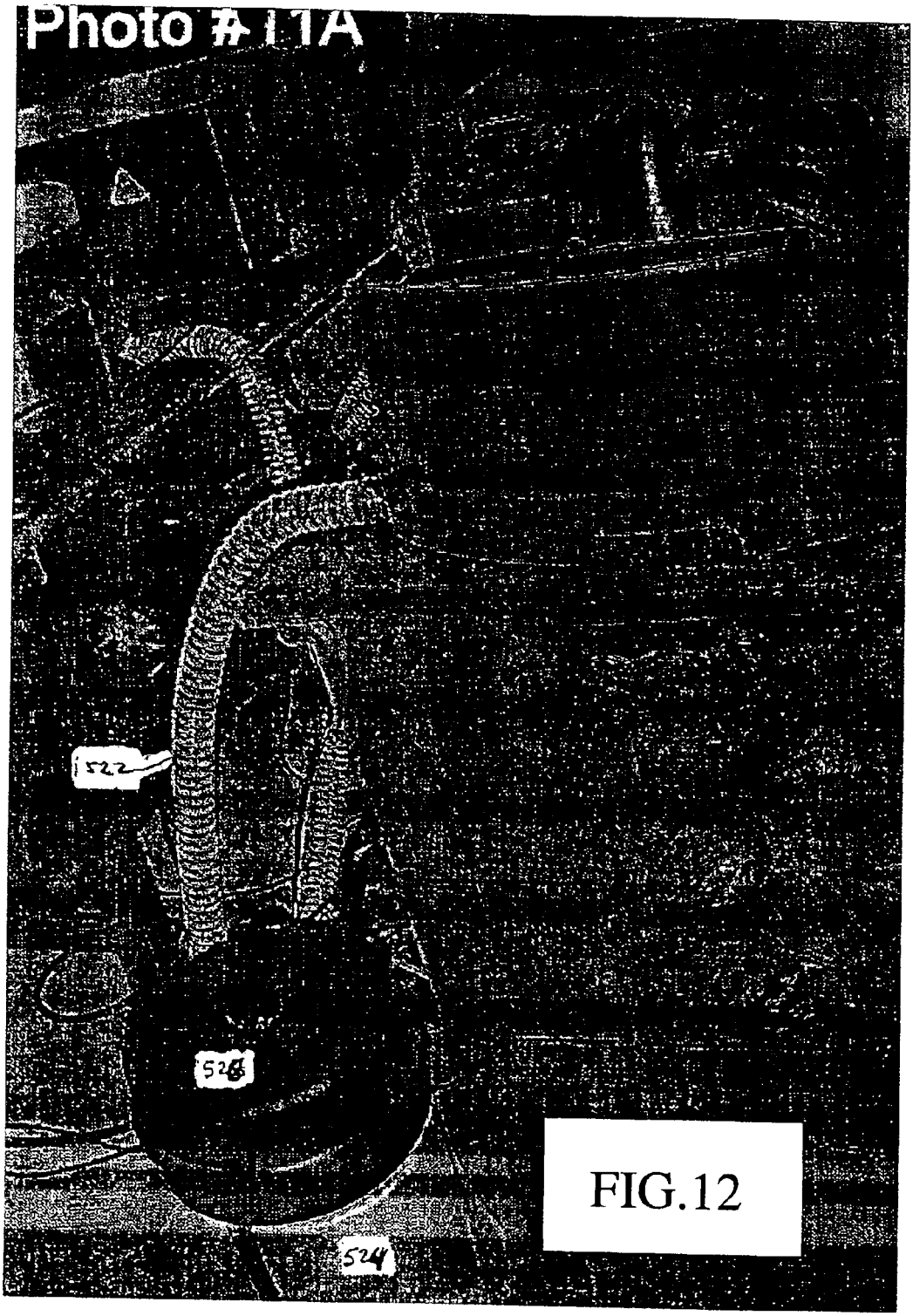
FIG. 12 is a perspective view of the vacuum system according to a preferred embodiment of the present invention.
Figure 13:
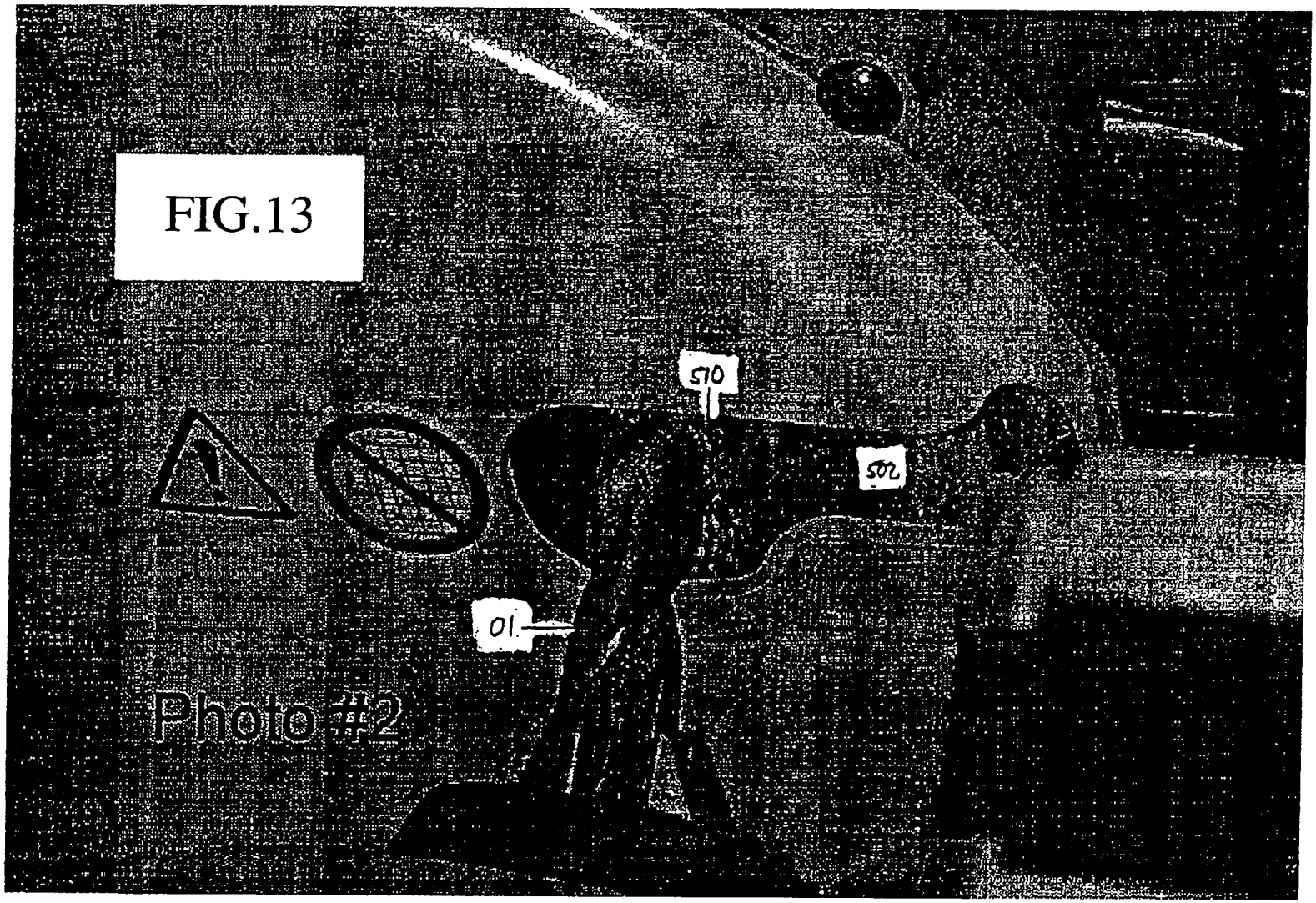
FIG. 13 is a perspective view showing a drill undergoing the honing process following sharpening of the drill.

Grind housing 512 is preferably shaped to provide a lower chamber 518 adjacent the area in which grinding wheel 502 and honing brush 510 are located. Front cover 516 has an opening and an annular protrusion 520 adjacent this chamber 518, in order to permit a vacuum hose 522 (FIGS. 11, 12) to be fastened thereto. Main base 102 has an opening 134 leading to an exterior of the unit, to allow the vacuum hose 522 to connect at one end to protrusion 520, and to extend out of the unit to a quiet, low speed vacuum system 524. The vacuum system pulls the debris generated in the sharpening operation and falling into chamber 518 out of the sharpener. The vacuum system 524 preferably includes a filtration system 526 which protects the operating parts of the vacuum system from the potentially damaging grit and debris, and further protects the machine operator from any health risks associated with this debris.

Front cover 516 has a slot 530 extending laterally from a point near the center of the grinding wheel 502 out past the outer peripheral edge of the grinding wheel. This slot 530 thus exposes a portion of the grinding wheel 502 and honing brush 510, to permit those elements to engage a tool to be sharpened and honed, as desired. Slot 530 must be of sufficient width to accommodate the larger drill and tool diameters, and to provide adequate clearance for the grinding wheel, taking into account the range of angles that the drill points will be sharpened to and the position of the drills when presented to obtain such angles. The slot 530 is preferably not oversized to any extent, in that this would result in more of the debris from the sharpening operation possibly escaping into the grind chamber 10.

Grind motor 504 is provided with a cooling shroud 560, through which cooling air is passed, in order to lower the operating temperature of the motor. This will have the effect of maximizing motor performance and increasing brush life. In the present design, it was found to be advantageous to employ a small amount of bleed air from the vacuum system, introduced into the shroud at a vacuum nipple 562, which passes between the shroud 560 and the motor casing (inside of shroud 560) and is exhausted. The drawing of this air over the motor casing was demonstrated to be an effective way of maintaining the motor temperature under a specified maximum temperature.

Another feature of the grind motor 560 is that the current drawn by the motor, which may preferably be a DC motor operating on 115/230 VAC supply and having a nominal current consumption of 1.5 A, is monitored in order to determine and control the force being exerted on the grind wheel while a drill or other tool is being sharpened. The rate of change and magnitude of the grind motor current consumption is then used to modulate (e.g., slow down and possibly stop) the motion of the infeed stage subassembly, the swing subassembly, the tool rotation subassembly, and the cross feed stage subassembly simultaneously. This will operate to prevent excessive grinding pressure being exerted, which leads to degradation of the grinding wheel surface, as well as to overheating and burning of the tool. The control of this coordinated motion will be dependent on both the diameter of the tool and the material from which the tool is made.

Figure 6:
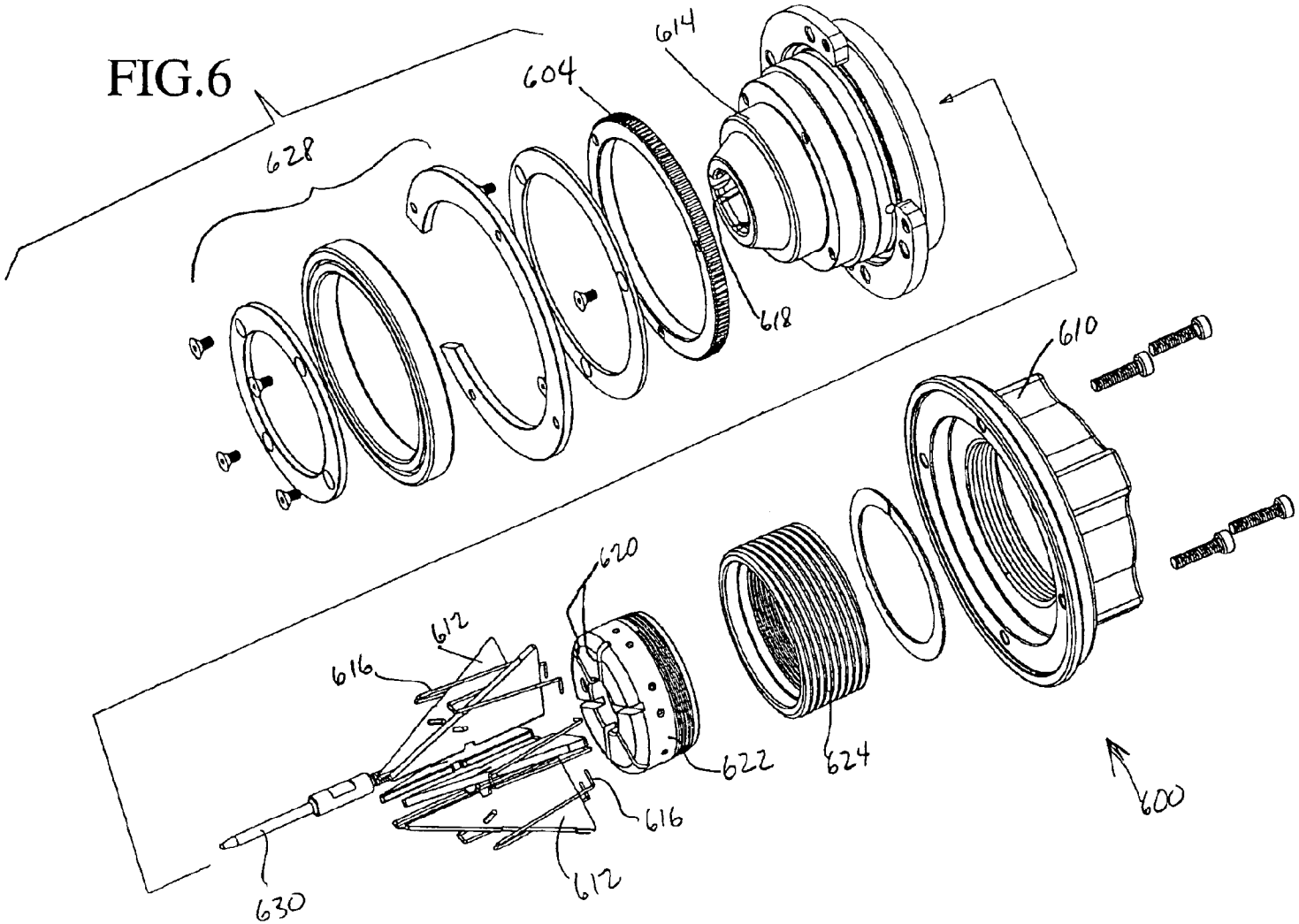
FIG. 6 is an exploded perspective view of the chuck assembly according to a preferred embodiment of the present invention.
Figure 7:
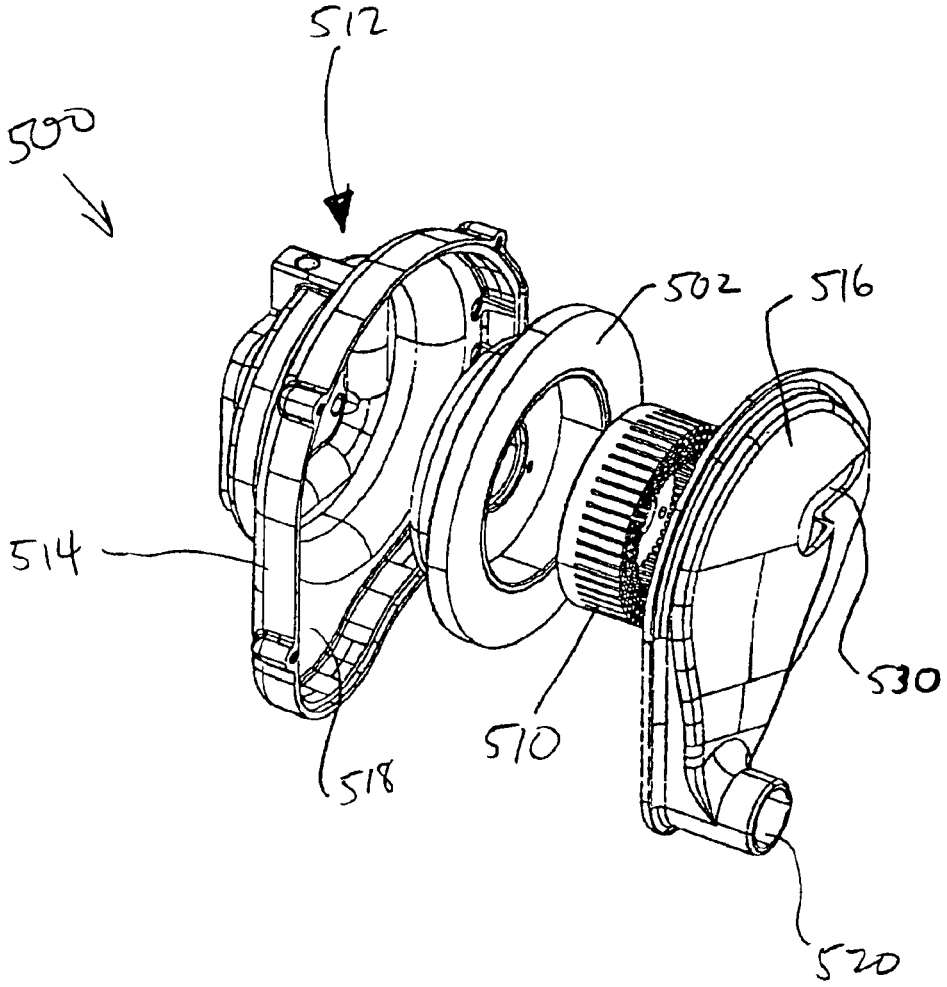
FIG. 7 is an exploded perspective view of the grinding wheel subassembly according to a preferred embodiment of the present invention.
Figure 8:
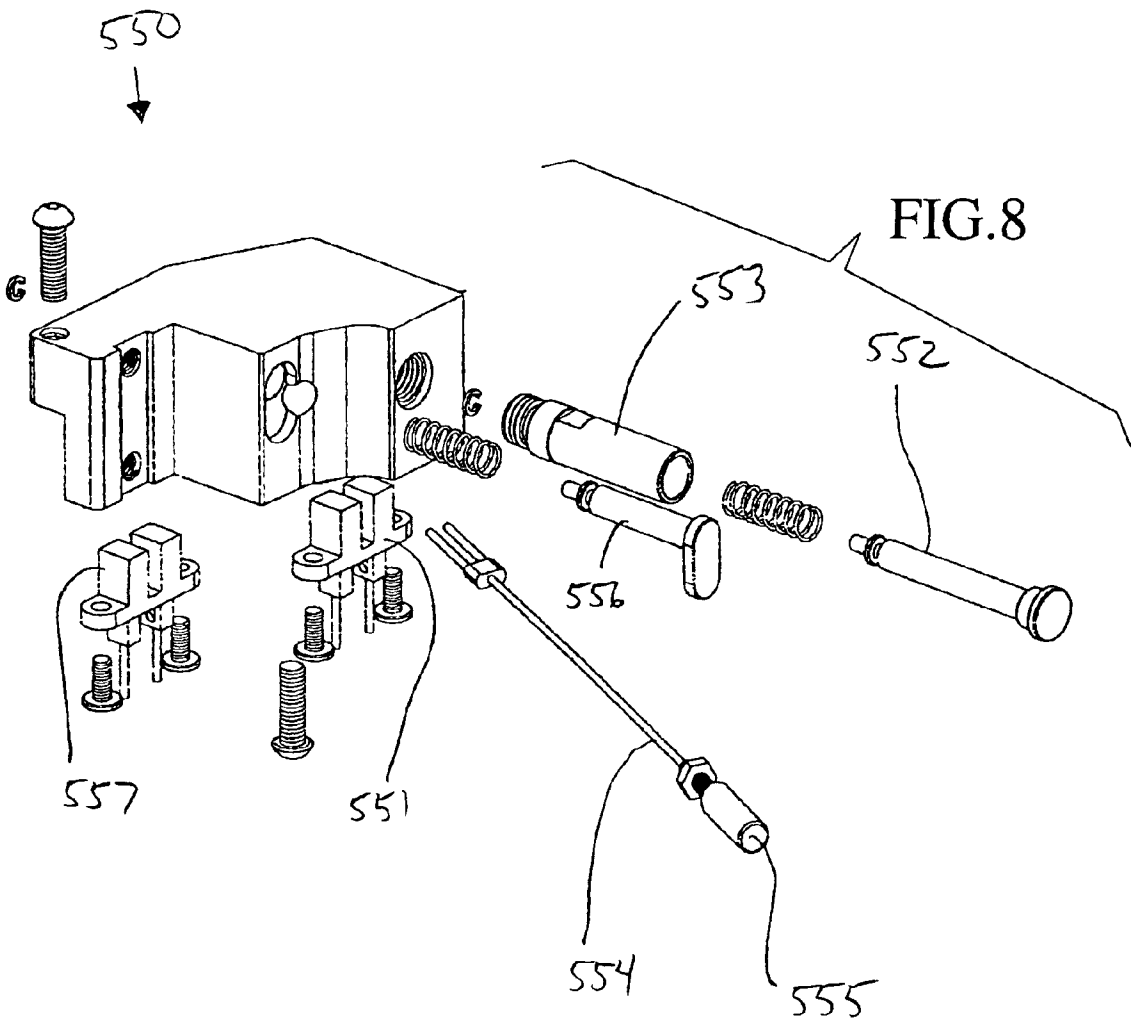
FIG. 8 is an exploded view of the alignment subassembly according to a preferred embodiment of the present invention.
Figure 9:
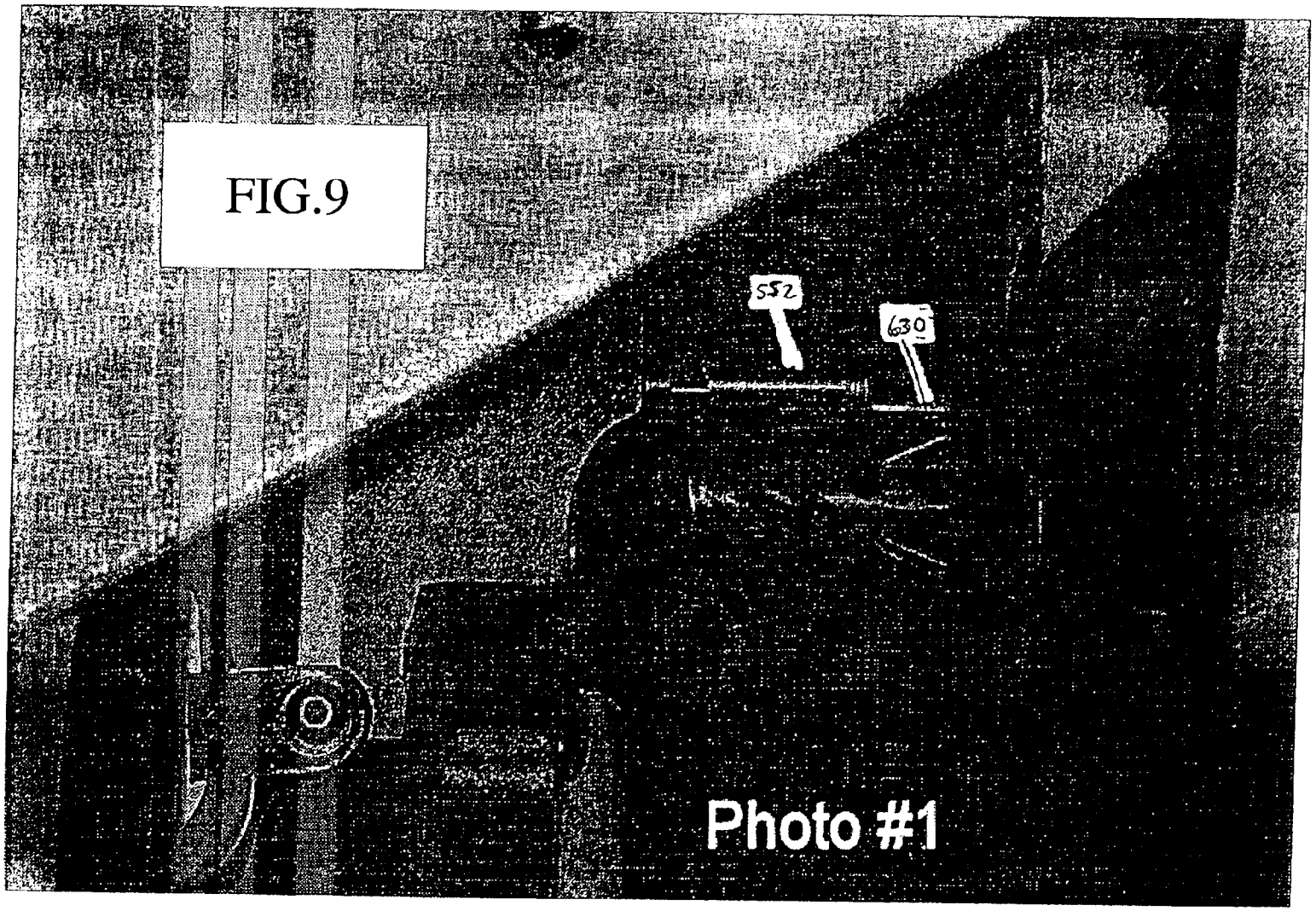
FIG. 9 is a top plan view showing the alignment subassembly in use in determining the drill diameter.
Figure 10:
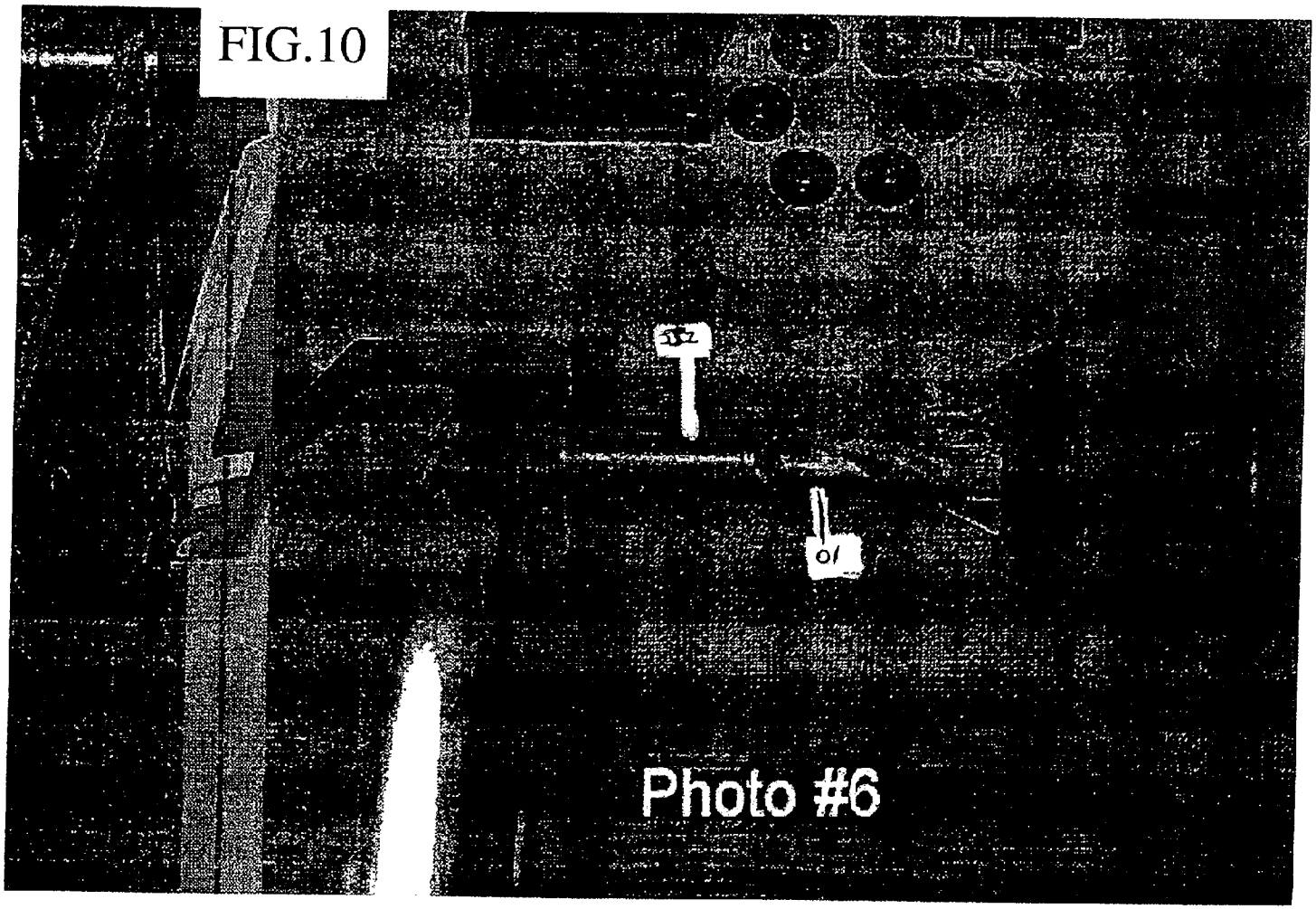
FIG. 10 is a perspective view showing the alignment subassembly in use in determining the length of the drill protruding from the chuck.

A compact chuck subassembly 600 is illustrated in FIG. 6. Once assembled, this chuck subassembly is fitted onto swing assembly 400, as is best seen in FIGS. 2 and 4. Chuck subassembly 600 comprises a chuck knob 610 and a chuck spindle 614 which retain therein a plurality (preferably six) chuck jaws 612 and their respective jaw springs 616. The chuck jaws are maintained in their radial orientation by slots 618 provided on an internal tapered surface of chuck spindle 614, as well as by radial slots 620 provided on backing screw or closing screw 622. A jaw spring retainer 624 is also provided at the rearward end of the jaw springs 616.

An annular drive gear 604 is mounted to the exterior of the chuck spindle 614, so that the chuck subassembly can be rotated during the sharpening process. A bearing structure 628 is also mounted to the chuck subassembly 600 to facilitate rotation thereof once mounted in swing subassembly housing 406.

A diameter detect rod 630 is attached to backing or closing screw 622, which will, once chuck subassembly 600 is fully assembled, protrude through the chuck spindle 614. Since backing screw 622 is moved forward as the chuck knob is turned to tighten the chuck jaws onto the drill which has been placed in the chuck, the distance to which diameter detect rod 630 protrudes from the chuck subassembly will have a direct relation to the diameter of the drill retained therein. This feature is advantageously used to detect the diameter of the drill to be sharpened without the need for very sophisticated and expensive sensors.

Mounted to the exterior of grind housing 512 is an alignment subassembly 550, which includes an alignment plunger assembly 552, a fiber optic sensor 554, and a material take off sensor 556. The alignment subassembly is used by the tool sharpener, in conjunction with the central processor 20, to automatically determine certain pertinent parameters or details of the drill or other tool to be sharpened. Alignment plunger assembly 552 is used to aid in sensing the length of the portion of diameter detect rod 630 protruding from chuck subassembly 600. This is accomplished by advancing the swing subassembly housing 406 toward alignment plunger 552, with the alignment plunger 552 positioned to engage the tip of the advancing diameter detect rod. Once contact is made, the plunger is pushed into plunger housing 553, and trips or triggers a switch 551 in the alignment plunger assembly 552, and a signal is sent to the infeed stage subassembly to cease advancing the swing subassembly. The length of the protruding portion of rod 630 is determined by the position at which the swing subassembly housing is stopped. Central processor 20 is programmed to be able to correlate this stopped position to a length of the protruding portion of rod 630, and also to correlate this length to a diameter of the drill or other tool retained in the chuck. The thus-determined drill diameter information is later used by the central processor in controlling the various aspects and stages of the sharpening process.

The length of the portion of the drill 01 protruding through chuck subassembly 600 is also automatically determined through the use of alignment plunger 552. In this case, the alignment plunger 552 and the drill 01 are brought into axial alignment by shifting the alignment plunger transversely, and the drill 01 is advanced into contact with the front surface of plunger 552, triggering the switch 551 in the pin, and halting the advance of the swing assembly. Again, the position of the swing subassembly housing on the infeed stage assembly is used by central processor 20 to determine the length of the portion of the drill extending forwardly or sticking out of chuck subassembly 600. This information is used by central processor 20 in controlling the amount of infeed to use during the sharpening process, which controls how much material is to be ground off in the sharpening process.

The fiber optic sensor 554 is employed to characterize (or crudely map or image) the cutting edge of the drill to be sharpened. The fiber optic sensor 554 is preferably constructed and installed on the subassembly to have a focal point on the order of several millimeters, for example seven millimeters, in front of the lens 555 of the sensor. The cross-feed subassembly 300 is used to move the sensor into axial alignment with the drill, and the infeed subassembly is used to move the cutting edge of the drill into the focal region of the fiber optic sensor 554. These steps, as are nearly all others, are preferably performed automatically, under the control of central processor, which has these pre-sharpening data gathering routines programmed or embedded therein.

The fiber optic sensor 554 is used to detect multiple points along the cutting edge of the drill 01 as the drill is rotated into different positions. Processor 20 is provided with an embedded algorithm or program that is capable of determining the web thickness of the drill using the data obtained by the fiber optic sensor. In addition, this data enables processor 20 to determine the orientation of the drill 01 being held by the chuck. The processor 20 is then able to send a command to the tool rotation step motor 412 to rotate the drill as necessary to properly orient the drill for the ensuing sharpening operation. The processor 20 uses the calculated web thickness in controlling the position of the drill during the sharpening operation.

As a further pre-sharpening data gathering step, material take-off (MTO) sensor 556 is used to determine when the drill will first contact the grinding wheel, so that the processor 20, infeed stage subassembly 200, and grind motor subassembly 500, will have advance notice as to when the contact and grinding will actually begin as the drill is advanced toward the grinding wheel. In this step, cross-feed stage subassembly 300 moves laterally to axially align the MTO sensor 556 with the drill 01. Processor 20 controls swing subassembly to position the drill at the appropriate orientation to sharpen the drill to the angle selected by the operator. The infeed stage subassembly advances the drill into contact with MTO sensor 556, which has a switch 557 that operates to cause cessation of the advance of drill 01. Processor 20 is thus able to determine from the stopped position of the swing subassembly when contact will first be made between the thus-positioned drill and the grinding wheel.

This feature is especially useful when a drill is to be sharpened to a different point angle than it originally had. When this information is known, the processor 20 can slow the infeed rate just prior to the anticipated contact, so that the drill is not advanced at an excessive speed, and the processor can begin monitoring the current reading of the grind motor, so as to further control the infeed rate to prevent excessive pressure being exerted on the grind wheel. This further prevents overheating and burning of the cutting edge of the drill. The use of the disclosed MTO sensor 556 is an inexpensive way to obtain this initial process control.

The limit switches used in the various subassemblies merit special discussion. Limit switches are provided in each of the infeed stage and cross-feed stage subassemblies, the switches being mounted in sensor housings or mounts 220, 802, for the infeed and cross-feed stages, respectively, as well as in the swing subassembly (not shown), and in the chuck or tool rotation subassembly, where the switch is designated at 806 (FIG. 4). These switches are preferably inexpensive optoelectronic sensors, however, with the control logic employed, these inexpensive sensors will allow fast and highly accurate operation.

The fast, accurate operation is obtained by using two sensing stages. First, a digital logic level is used, whereby motion into the limit switch may be fast, and is digitally detected, albeit not with high accuracy. Once a preset digital trip point is hit, the speed is reduced and the sensing changes to an analog sensing. Motion of the slowed element is then stopped at a preset analog voltage, which is highly accurate and precise.

Figure 14A:
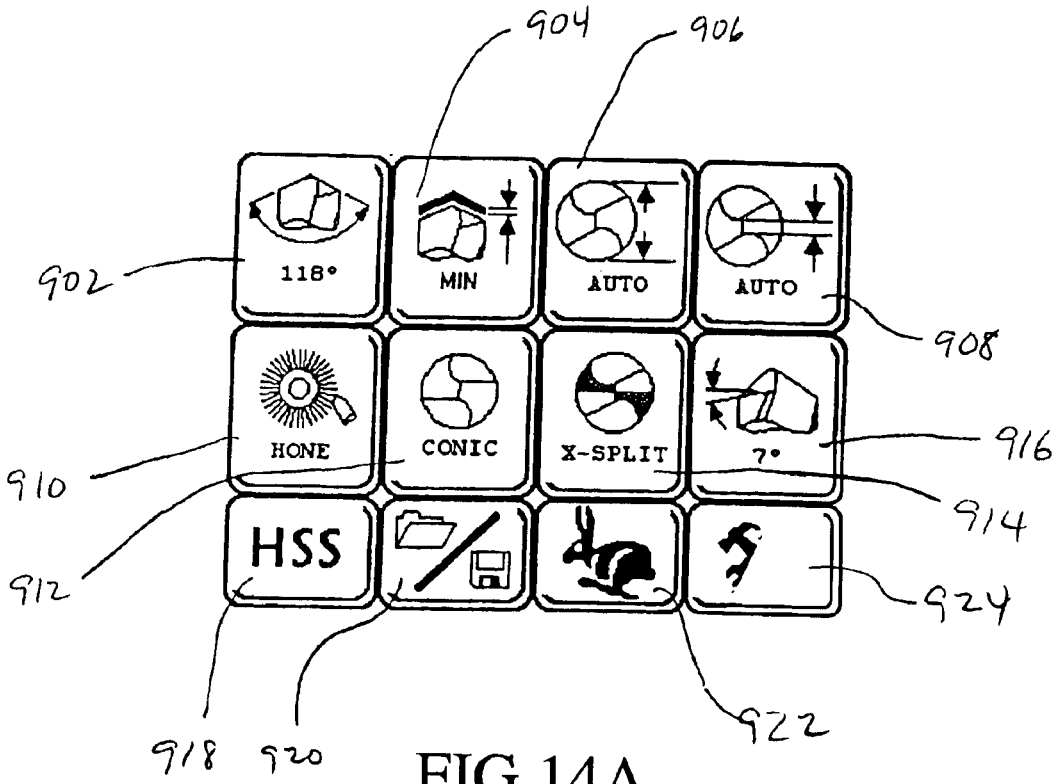
FIGS. 14A and 14B are schematic illustrations of the user interface provided for operator input in commencing the sharpening process.
Figure 14B:
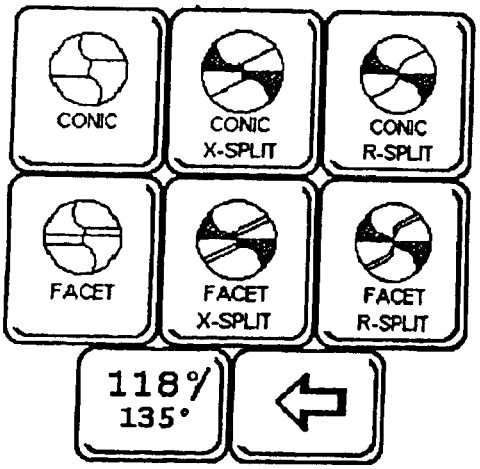

FIGS. 14A and B illustrate an example of the operator interface 900 presented at console 118. FIG. 14A is the main setup screen, and FIG. 14B represents a subsequent screen that is presented to the operator after the operator has initially selected the "quick start" feature at the main setup screen, which is expected to be used in most instances in sharpening drills. The other choices presented on the main startup screen are provided for advanced users to customize the sharpening operation to their specific and unique needs.

FIG. 14A shows a point angle selection button/icon 902, a material removal icon 904, a drill diameter size icon 906, a web thickness selector icon 908, a hone selection icon 910, a point type grind selector icon 912, a split point selector icon 914, a relief angle selector 916 (for lip relief), a drill material selector icon 918, a memory open icon (for settings stored in memory) 920, the "quick start" icon 922, and a maintenance icon 924.

As noted previously, the central processor is programmed with defaults and automated routines to handle most of these functions and selections automatically. For example, the material removal in the sharpening process has a default value (used in the "quick start" routine, and if not otherwise overridden in manual mode) that will minimize the amount of material removed in the sharpening process, for example, in the range of about 0.005 to 0.008 inches. This will prolong the life of the drill, by permitting more resharpenings. However, if the cutting edge of the drill is damaged, as by a nick or gouge, then additional drill material would need to be removed in order to present a uniform new cutting edge. In such instances, the material removal icon would be pressed, in order to provide the operator with additional choices as to the amount of material that is to be removed during the sharpening operation.

In continuing with the example of the primary mode of operation, the operator would insert a drill to be sharpened into the chuck, and the operator would tighten the chuck and close the guard door 112. The operator would then touch the "quick start" icon 922, and would be presented with the interface or screen illustrated in FIG. 14B. At this screen, the operator would select one of four standard point styles or types (conic or facet: no split or X-split), and one of the two point angles (defaults to 118°, toggles to 135° upon touching). The operator would then press a "cycle start" button (one of those shown at 120), and the tool sharpener will automatically sharpen the drill.

Without any overrides being made, the automated sharpening process will include the following steps (which have previously been described in discussing the components that perform the steps):

determining the diameter of the drill to be sharpened;

determining the length of the portion of the drill protruding from the chuck;

determining the web thickness of the drill;

properly orienting the cutting edge of the drill for the sharpening procedure;

determining the point of infeed at which contact will be initiated between the drill and the grinding wheel;

controlling the infeed stage subassembly, the swing subassembly, the tool rotation subassembly, and the cross-feed stage subassembly as necessary to grind the cutting edge of the drill to remove material therefrom in sharpening the drill;

monitoring the current drawn by the grind motor in order to control the amount of pressure being exerted on the grinding wheel; and when a honing step is to be performed, moving the grinding wheel assembly laterally to present the honing brush to the newly sharpened drill cutting edge.

The central processor 20 in this tool sharpener is also capable of storing a number of custom sharpening routines programmed by the operator by using the various options presented at the main setup screen on console 118.

The sharpener is preferably provided with both cubic boron nitride (CBN) and diamond coated or plated wheels, which are standard in the field. The wheel coatings, typically known as a superabrasives, permit the sharpening of high strength steel (HSS), cobalt and carbide cutting tools.

Additional features and functions provided by the tool sharpener described and shown herein will be readily apparent to those having ordinary skill in the art upon reading this disclosure. The foregoing discussion of the preferred embodiments of the invention is for illustrative purposes only, and is not intended to limit the scope of the invention.

What is claimed is:

1. A tool sharpener comprising:

a grinding wheel subassembly comprising a grinding wheel;

a tool holder subassembly adapted to retain a tool to be sharpened;

an infeed stage subassembly operatively coupled to said tool holder subassembly and adapted to move said tool holder subassembly in a direction toward and away from said grinding wheel subassembly;

a cross-feed subassembly operatively coupled to said grinding wheel subassembly and adapted to move said grinding wheel assembly laterally relative to a tool to be sharpened;

a processor operatively coupled to said grinding wheel subassembly, said tool holder subassembly, said infeed stage subassembly and said cross-feed subassembly, and adapted to control operation of each of said subassemblies and wherein said grinding wheel assembly further comprises a honing brush removably secured to said grinding wheel and positioned at an inner periphery thereof.

2. A tool sharpener as recited in claim 1, further comprising a swing subassembly operatively coupled to said tool holder subassembly and being so constructed and arranged to tilt said tool holder subassembly through a range of angular orientations relative to said grinding wheel subassembly, said swing assembly also being operatively coupled to said processor for control of said swing assembly.

3. A tool sharpener comprising:

a grinding wheel subassembly comprising a grinding wheel;

a tool holder subassembly adapted to retain a tool to be sharpened;

a user interface operatively coupled to a processor whereby a user may select a particular type of sharpening operation for sharpening a tool;

means operatively coupled to said processor for controlling said tool holder subassembly and said grinding wheel subassembly to automatically perform a sharpening operation selected at said user interface and wherein said grinding wheel assembly further comprises a honing brush removably secured to said grinding wheel and positioned at an inner periphery thereof.

4. A tool sharpener as set forth in claim 3, wherein said grinding wheel subassembly further comprises a grind motor, and wherein said tool sharpener further comprises a grinding controller comprising a grind motor current sensor operatively coupled to said processor and wherein said processor is programmed to control a force of a tool being sharpened against said grinding wheel in response to a sensed grind motor current.

5. A tool sharpener as set forth in claim 4, wherein said grind motor comprises a shroud at least partially enclosing a case of said grind motor, and means for drawing air across said grind motor case through said shroud.

6. A tool sharpener as set forth in claim 3, wherein said grinding wheel assembly further comprises a grinding wheel cover which substantially encloses said grinding wheel, said cover having a slot therein for introducing a tool onto a surface of said grinding wheel, and a vacuum system connected to said cover, said vacuum system being so constructed and arranged to remove debris collected inside said grinding wheel cover.

7. A tool sharpener as set forth in claim 6, wherein said vacuum system includes a filtration system adapted to separate debris from a flowing air stream.

8. A tool sharpener as set forth in claim 3, further comprising a sensor for automatically detecting a cutting edge of said tool to be sharpened, means for transmitting information identifying said cutting edge to said processor, and means for adjusting, as necessary, an orientation of said cutting edge of said tool to a predetermined grind position.

9. A tool sharpener as set forth in claim 3, further comprising a sensor for automatically detecting a length of a tool projecting from said tool holder subassembly, and means for transmitting information directed to said sensed length to said processor.

10. A tool sharpener as set forth in claim 3, wherein said tool sharpener is so constructed and arranged to sharpen drills, wherein said tool holder subassembly comprises a chuck subassembly, and wherein said chuck subassembly has a rod which protrudes from a face of the chuck subassembly to a length dependent upon a diameter of a drill being retained therein;

said tool sharpener further comprising a sensor for determining a length of said rod protruding from said chuck, and means for transmitting information sensed regarding a protruding length of said rod to said processor, said processor being programmed to contain data correlating sensed lengths to drill diameters, whereby a diameter of a drill retained by said chuck subassembly may be determined by said processor based upon a sensed length of said protruding rod.

11. A tool sharpener as set forth in claim 3, farther comprising:

an infeed stage subassembly operatively coupled to said tool holder subassembly and adapted to move said tool holder subassembly in a direction toward and away from said grinding wheel subassembly;

a cross-feed subassembly operatively coupled to said grinding wheel subassembly and adapted to move said grinding wheel assembly laterally relative to a tool to be sharpened; and wherein said processor is operatively coupled to said infeed stage subassembly and said cross-feed subassembly, and is adapted to control operation of each of said subassemblies.

12. A tool sharpener as recited in claim 11, further comprising a swing subassembly operatively coupled to said tool holder subassembly and being so constructed and arranged to tilt said tool holder subassembly through a range of angular orientations relative to said grinding wheel subassembly, said swing assembly also being operatively coupled to said processor for control of said swing assembly.

13. A tool sharpener as set forth in claim 1, wherein said grinding wheel subassembly further comprises a grind motor, and wherein said tool sharpener further comprises a grinding controller comprising a grind motor current sensor operatively coupled to said processor and wherein said processor is programmed to control a force of a tool being sharpened against said grinding wheel in response to a sensed grind motor current.

14. A tool sharpener as set forth in claim 13, wherein said grind motor comprises a shroud at least partially enclosing a case of said grind motor, and means for drawing air across said grind motor case through said shroud.

15. A tool sharpener as set forth in claim 1, wherein said grinding wheel assembly further comprises a grinding wheel cover which substantially encloses said grinding wheel, said cover having a slot therein for introducing a tool onto a surface of said grinding wheel, and a vacuum system connected to said cover, said vacuum system being so constructed and arranged to remove debris collected inside said grinding wheel cover.

16. A tool sharpener as set forth in claim 6, wherein said vacuum system includes a filtration system adapted to separate debris from a flowing air stream.

17. A tool sharpener as set forth in claim 3, further comprising a sensor for automatically detecting a cutting edge of said tool to be sharpened, means for transmitting information identifying said cutting edge to said processor, and means for adjusting, as necessary, an orientation of said cutting edge of said tool to a predetermined grind position.

18. A tool sharpener as set forth in claim 3, further comprising a sensor for automatically detecting a length of a tool projecting from said tool holder subassembly, and means for transmitting information directed to said sensed length to said processor.

19. A tool sharpener as set forth in claim 3, wherein said tool sharpener is so constructed and arranged to sharpen drills, wherein said tool holder subassembly comprises a chuck subassembly, and wherein said chuck subassembly has a rod which protrudes from a face of the chuck subassembly to a length dependent upon a diameter of a drill being retained therein;

said tool sharpener further comprising a sensor for determining a length of said rod protruding from said chuck, and means for transmitting information sensed regarding a protruding length of said rod to said processor, said processor being programmed to contain data correlating sensed lengths to drill diameters, whereby a diameter of a drill retained by said chuck subassembly may be determined by said processor based upon a sensed length of said protruding rod.

* * * * *